US008714208B2

(12) United States Patent
Niepoth

(10) Patent No.: US 8,714,208 B2
(45) Date of Patent: May 6, 2014

(54) CONTAINER FOR RECEIVING A FLUID

(75) Inventor: Günther Niepoth, Darmstadt (DE)

(73) Assignee: Kao Germany, Darmstadt (DE)

( * ) Notice: Subject to any disclaimer, the term of this patent is extended or adjusted under 35 U.S.C. 154(b) by 513 days.

(21) Appl. No.: 13/000,923

(22) PCT Filed: Aug. 25, 2009

(86) PCT No.: PCT/EP2009/006140
§ 371 (c)(1),
(2), (4) Date: Dec. 22, 2010

(87) PCT Pub. No.: WO2010/022912
PCT Pub. Date: Mar. 4, 2010

(65) Prior Publication Data

US 2011/0121018 A1 May 26, 2011

(30) Foreign Application Priority Data

Aug. 29, 2008 (EP) ..... 08163328

(51) Int. Cl.
*B65B 31/00* (2006.01)
*B65B 3/04* (2006.01)

(52) U.S. Cl.
USPC ..... 141/27; 141/2; 141/5; 141/105; 222/1; 222/380; 222/387

(58) Field of Classification Search
USPC ..... 141/2–5, 18, 21, 22, 25, 27, 100, 105; 222/1, 372, 380, 386, 387
See application file for complete search history.

(56) References Cited

U.S. PATENT DOCUMENTS

| | | | | | |
|---|---|---|---|---|---|
| 2,771,346 | A * | 11/1956 | Lambers | 422/278 |
| 3,698,453 | A * | 10/1972 | Morane et al. | 141/349 |
| 5,405,051 | A * | 4/1995 | Miskell | 222/23 |
| 6,435,231 | B1 * | 8/2002 | Cooper et al. | 141/346 |
| 6,848,601 | B2 * | 2/2005 | Greer, Jr. | 222/136 |
| 7,063,236 | B2 * | 6/2006 | Greer et al. | 222/136 |
| 2006/0278301 | A1 | 12/2006 | Greer, Jr. | |
| 2007/0221513 | A1 * | 9/2007 | Taylor-Sharp et al. | 206/219 |
| 2011/0032788 | A1 * | 2/2011 | Hofte | 366/130 |

FOREIGN PATENT DOCUMENTS

| | | | |
|---|---|---|---|
| DE | 81 12 183 | U1 | 8/1982 |
| EP | 0 527 532 | A | 2/1993 |
| FR | 330 709 | A | 3/1903 |
| WO | 2007/111667 | A | 10/2007 |

OTHER PUBLICATIONS

International Search Report dated Oct. 19, 2009.

* cited by examiner

*Primary Examiner* — Gregory Huson
*Assistant Examiner* — Nicolas A Arnett
(74) *Attorney, Agent, or Firm* — Norris McLaughlin & Marcus PA

(57) ABSTRACT

A container is provided comprising a receiving vessel (12) and an outlet part (14), wherein the outlet part (14) comprises a one-way valve (24) and at least one bypass passage (32) bypassing the one-way valve (24), wherein the outlet part (14) is at least partly movable with respect to the receiving vessel (12) between a closed position and an opened position, wherein in the closed position the receiving vessel (12) seals the bypass passage (32) and in the opened position the receiving vessels (12) unseals the bypass passage (32). Due to the one-way valve (24) of the alternative container (10) the filling is facilitated without complicating emptying, since it is prevented that the content (42) of the container (10) flows back accidently.

13 Claims, 5 Drawing Sheets

CONTAINER FOR RECEIVING A FLUID

This application is a 371 application of PCT/EP2009/006140 filed Aug. 25, 2009, which claims foreign priority benefit under 35 U.S.C. §119 of European Application No. 08163328.1 filed Aug. 29, 2008.

FIELD OF THE INVENTION

The invention relates to a container, by means of which a fluid, particularly a liquid, may be received and emptied.

BACKGROUND OF THE INVENTION

From WO 2007/111667 A2 a container is known, which comprises a receiving vessel for receiving a liquid mixture. The receiving vessel may be screwed to an adapter. The adapter comprises two outlet parts, wherein each outlet part may be screwed to an outlet of a receiving vessel of a container. The outlet parts are loss-proof connected to each other but displaceable in axial direction. The one outlet part comprises a centrally located protrusion which is spaced to an outlet duct of its outlet part by webs. In a closed position the protrusion is inserted into a corresponding outlet duct of the other outlet part plugging the outlet duct and preventing a communication of both containers with each other. In an opened position the protrusion is removed from the corresponding outlet duct opening a communicating passage between both containers.

It is a disadvantage of such kind of a container, that it is difficult to estimate the amount of a component filled into the container via the adapter. Further it is observed, that a mixture of two components, which were mixed in the container, may comprises not solved or not mixed conglomerates independently of the mixing time. Particularly when this container is used for mixing a hair treatment lotion for coloration, tinting or bleaching human hair, it is important to provide good mixing quality. If for instance oxidative dyes and an oxidizing lotion are mixed with each other, different concentrations within the hair treatment lotion may lead to different colour shades of the hair at different places.

It is an object of the present invention to provide an alternate container for receiving a fluid and/or a mixture of fluids. It is particularly an object of the present invention to provide a container, which facilitates filling without complicating emptying. Particularly it is an object of the present invention to provide a container, which facilitates measuring and mixing of its content and/or provides a better mixing quality.

DESCRIPTION OF THE INVENTION

This object is achieved by the features of claim 1. Preferred embodiments are given by the dependent claims.

According to the invention a container is provided comprising a receiving vessel and an outlet part, wherein the outlet part comprises a one-way valve and at least one bypass passage bypassing the one-way valve, wherein the outlet part is at least partly movable with respect to the receiving vessel between a closed position and an opened position, wherein in the closed position the receiving vessel seals the bypass passage and in the opened position the receiving vessels unseals the bypass passage.

Due to the one-way valve of this alternative container the filling is facilitated without complicating emptying, since it is prevented, that the content of the container flows back accidently. Depending of the content and the applied pressure of a container, from which the content should be filled into the container according to the invention, a different back pressure is prevented, since additional pressure drops points are prevented. This facilitates particularly the filling of pressurized fluids, particularly an aerosol. Particularly the estimation of the amount of the filled content is facilitated, since the filled amount corresponds to the pressure inside the container. For instance the amount of a filled aerosol can be estimated by the filling sound of the aerosol. Since the one-way valve prevents a back flow, a mixing of the content does not lead to a leakage. Particularly filling and mixing may be performed at the same time. Particularly different ways are used for filling and emptying the container. The risk, that residual components located in the inlet, particularly within the one-way valve, may be washed out during emptying the container, is prevented. The risk, that the content of the container comprises not solved or not mixed conglomerates, is reduced leading particularly to an increased mixing quality. Particularly when the container is used for mixing a hair treatment lotion for coloration, tinting or bleaching human hair, different concentrations within the hair treatment lotion are prevented. Further the receiving vessel provides in addition the function of closing and opening the bypass passage. The material of the receiving vessel itself can close the bypass passage without the need for additional closing means. An additional closing member or a complicatedly shaped outlet part is not necessary leading to a facilitated design of the container. For instance the receiving vessel may comprise a formed mouth, which fits into the bypass passage for sealing the bypass passage in the closing position. Particularly the one-way valve and the bypass passage are arranged coaxially facilitating the closing of the bypass passage by means of the receiving vessel, particularly a tubular part of the receiving vessel. Just a short movement of the outlet part with respect to the receiving vessel is sufficient to change the flow direction, wherein it may be safeguarded that only one flow direction at the same time is set. It is understood that the receiving vessel is a body, particularly hollow body, for storing a content like a liquid and/or aerosol, wherein the body may comprises an opening for providing a communication between the stored content and the outlet part for depleting the content out of the body of the receiving vessel via the outlet part. The receiving is particularly flask-like and/or bottle-like and/or mainly tubular, wherein the body particularly may comprise a movable bottom. The outlet part can be designed as a cap, which can be partially stick onto the receiving vessel press fitted or with clearance.

Preferably the outlet-part comprises an outlet duct and the one-way valve is connected to the outlet duct via at least one web, wherein the bypass passage is provided between the outlet duct, the one-way valve and the web. The one-way valve may be arranged centrally, particularly coaxially with respect to the outlet duct. The one-way valve may be also arranged centrally with respect to a plurality of several bypass passages. Since the area of the one-way valve is separated from the bypass passage and it is safeguarded, that the content of the receiving vessel does not flow through parts of the one-way valve, the content does not wash out the one-way valve, so that unwanted dirt particles are not picked up during emptying the content of the container.

Adjacent bypass passages may by separated in circumferential direction by only a narrow web, wherein the thickness of the web is just sufficient to take up expected forces applied to the one-way valve. This leads to high flow cross section for emptying the receiving vessel at a given space of the outlet part. In an alternate embodiment it is possible to provide at least one opening like a trough hole in a disc, wherein the residual disc provides the webs. When the cross section of the opening in the disc is smaller than the adjacent material of the disc, it is possible to open and close the opening by means of a correspondingly shaped blocking disc, which abuts the disc with the webs and is rotatable with respect to this disc. The blocking disc may be connected with the receiving vessel, so that a small turning of the outlet part leads to an opening and/or closing of the bypass passages. Particularly the blocking disc may be pivotally supported by the one-way valve. Small bypass passages with a comparatively small cross section are particularly preferred, when the content of the receiving vessel should be provided as foam.

Particularly the receiving vessel comprises an outlet opening defined by a border wall, wherein the border wall seals the bypass passage in the closed position. Due to this design it is not necessary to provide an additional seal member. The sealing is provided by the border wall of the outlet opening itself. The border wall may abut the webs for closing the bypass passages. Further the border wall may be particularly press fitted received by a correspondingly shaped slot between the one-way valve and the outlet duct of the outlet part. The border wall may comprise a chamfer and/or a wedge-like cross section for facilitating the insertion of the border wall into the slot. Particularly the border wall may be provided with a sealing coating for instance a rubber-like material.

In a preferred embodiment the relative movement of the outlet part to the receiving vessel is defined by a guiding, particularly by a bayonet guiding or a guide rail, wherein the guiding preferably comprises a projection inserted into a slot. Further the guiding may be a thread or just a blocking means, which blocks an axial movement of the outlet part. The blocking means may limit the movement of the outlet part between two blocking positions, which correspond to the opened position and the closed position (sealing position). Due to the guiding a more complex movement of the outlet part is possible. Particularly a turning as well as an axial displacement of the outlet part with respect to the receiving vessel at the same time and/or subsequent may by forced by the guiding. Further the guiding may comprises stops for limiting the movement of the outlet part with respect to the receiving vessel. Due to the stops a maximum opening position and a minimum opening position, that means a sealing position, may be defined by the guiding. Preferably the outlet part partially surrounds the receiving vessel along a supporting area, wherein the receiving vessel is particularly cylindrically shaped at the supporting area. The guiding may be located within the supporting area, so that the projection guided by the guiding slot may be easily provided. Further the outlet part is supported by the receiving vessel.

Particularly the outlet part is turnable around an axis pointing in axial direction of the receiving vessel and/or displaceable in axial direction of the receiving vessel. Due to this movement the bypass passages may be easily opened and closed. The maximum turning angle $\alpha$ may be $20° \leq \alpha \leq 90°$, particularly $30° \leq \alpha \leq 70°$ and preferably $40° \leq \alpha \leq 50°$. Further the turning axis may be coaxial to the receiving vessel; this means the outlet part is turnable around the middle axis of the receiving vessel.

Preferably the outlet part comprises a thread for fastening a second container. Due to the fastening the second container may be even gas tight connected to the outlet part so that the content of the second container may not flow outwards. Particularly when the content of the second container is an aerosol it is prevented that the second container slips out the one-way valve due to back pressure and/or that the aerosol leaks.

In a preferred embodiment the one-way valve is a check valve comprising a ball for closing an inlet opening, wherein the ball is loaded by a spring, wherein particularly the ball and the spring are arranged inside a cage. When no pressure is applied to the one-way valve, the one-way valve is closed by the spring loaded ball. When a fluid is filled into the container, the ball is pressed out the way by means of an applied pressure. Depending on the spring force a sufficient pressure for opening the one-way valve may be the weight force of a liquid filled into the one-way valve, for instance by means of a bottle or a beaker. Further the one-way valve may be opened by an applied negative pressure inside the receiving vessel. By means of the negative pressure not only the one-way valve may be opened but also a fluid may be sucked in, even against gravity direction.

In a further embodiment the one-way valve is a check valve comprising a particularly spring-loaded lid for closing an inlet opening, wherein the lid is particularly pivotable, preferably by means of a film hinge. When a fluid is filled into the container the applied pressure opens the lid. After the filling the pressure from outside stops and the pressure inside the receiving vessel may close the lid. This leads to a simple design of the one-way valve easily to be manufactured. Depending on the spring force of the lid a sufficient pressure for opening the one-way valve may be the weight force of a liquid filled into the one-way valve, for instance by means of a bottle or a beaker. By means of a negative pressure inside the receiving vessel not only the one-way valve may be opened but also a fluid may be sucked in, even against gravity direction.

Preferably the viscosity of the component, which should be filled into the container, is chosen such, that the component is capable of being sucked into the container by means of an applied negative pressure inside the container, wherein the negative pressure particularly counteracts a closing force of the one-way valve, and/or by means of a gravity force of the component, which at least counteracts the closing force of the one-way valve. Particularly the viscosity is chosen such, that the component can be sucked in against gravity direction. Due to this chosen viscosity of the component it is safeguarded, that the one-way valve is not clogged by the component.

Particularly the receiving vessel comprises a piston for changing the receiving volume of the receiving vessel, wherein particularly the piston is connected to a stem for manipulating the piston from outside the receiving vessel. By changing the volume of the receiving vessel the pressure inside the receiving vessel may be handled or even controlled. Particularly it is possible to apply a negative pressure inside the receiving vessel for opening the one-way valve and/or for sucking in a fluid. Further an increased pressure can be applied for facilitating the emptying of the receiving vessel.

In a further embodiment a mixing element is provided inside the receiving vessel, wherein the mixing element is actuatable from outside the receiving vessel particularly via an actuating stem connected to the mixing element. The mixing element may be a propeller, which can be turned by means of the actuating stem. The actuating stem may be supported inside the stem, which is used to move the piston. Further the mixing element may be received by the piston and pressed out of the piston by means of the actuating stem for turning the mixing element. Due to the mixing element the content of the receiving vessel may be mixed at will. In addition or in alternate the content of the receiving vessel may be mixed by shaking the container.

Preferably the receiving vessel and/or the outlet part and/or the stem comprises at lease one scale for measuring the volume of a component filled into the container. The measurement of the volume of the filled components facilitates the mixing of different components. Particularly when a hair treatment lotion should be mixed, the correct amount of each substance is important to adjust the wanted shade of the hair.

The invention further relates to a container system comprising a first container, which may be designed as previously described, and a second container connected to the first container via the one-way valve, wherein the second container comprises a component to be filled into the first container. Due to the one-way valve of this alternative container system the filling of the first container is facilitated without complicating emptying, since it is prevented that the content of the first container flows back accidently. Particularly different ways are used for filling and emptying the first container. This risk that residual components of the second container located in the inlet, particularly within the one-way valve, may be washed out during emptying the first container is prevented leading to an increased mixing quality of a mixture mixed in the first container.

Particularly the component of the second container comprises a liquid and/or an aerosol and/or a substance capable of flowing, wherein particularly the viscosity of the component is chosen such, that the component is capable of being sucked into the first container by means of an applied negative pressure inside the first container, wherein the negative pressure particularly counteracts a closing force of the one-way valve, and/or by means of a gravity force of the component, which at least counteracts the closing force of the one-way valve. Particularly the viscosity is chosen such, that the component can be sucked in against gravity direction. Due to this chosen viscosity of the component it is safeguarded, that the one-way valve is not clogged by the component.

Preferably the second container is adapted to apply a pressure to the component of the second container, particularly by means of a press piston and/or a pressurized gas. Due to the increased or increasable pressure inside the second container, the closing force of the one-way valve can be easily counteracted facilitating the filling of the first container.

The invention further relates to a use of a container as previously described and/or a container system as previously described for applying a hair treatment means, particularly a hair coloration lotion, a hair tinting lotion and/or a hair bleaching lotion. Due to the one-way valve the filling of the container is facilitated without complicating emptying, since it is prevented that the content of the container flows back accidently. Particularly different ways are used for filling and emptying the container. This risk, that residual components located in the inlet, particularly within the one-way valve, may be washed out during emptying the first container, is prevented leading to an increased mixing quality of a mixture mixed in the first container. The container and/or container system is particularly suitable for mixing a hair treatment lotion for coloration, tinting or bleaching human hair, due to its good mixing quality. If for instance oxidative dyes and an oxidizing lotion are mixed with each other, different local concentrations within the hair treatment lotion are prevented, so that a single colour shade for the whole hair is possible.

The invention further relates to a method for providing a composition, particularly a hair treatment lotion, comprising the steps of providing a first container, which may be designed as previously described, in closed position, filling at least one component into the first container via the one-way valve, moving the outlet part with respect to the receiving vessel in opened position and emptying the content of the first container via the bypass passage. Due to the one-way valve the filling of the container is facilitated without complicating emptying, since it is prevented that the content of the container flows back accidently. Particularly different ways are used for filling and emptying the container. This risk that residual components located in the inlet, particularly within the one-way valve, may be washed out during emptying the first container is prevented leading to an increased mixing quality of a mixture mixed in the first container.

The mixing may be performed by means of a mixing tool. For instance the mixing tool comprises a mixing element located inside the receiving vessel, wherein the mixing element may be actuated from outside the receiving vessel for instance via an actuating stem connected to the mixing element. The mixing element may be a propeller, which can be turned by means of the actuating stem. The actuating stem may be supported inside the stem, which is used to move the piston. Further the mixing element may be received by the piston and pressed out of the piston by means of the actuating stem for turning the mixing element. Due to the mixing element the content of the receiving vessel may be mixed at will. In addition or in alternate the content of the receiving vessel may be mixed by shaking the container.

Particularly prior to moving the outlet part in opened position the first container is shaken for mixing at least two components. The shaking is particularly performed by hand. An additional mixing tool is not necessary. Due to the one-way valve it is possible to fill more or different components into the container without moving the outlet part, but at the same time no part of the content inside the container may escape. For instance a hair dresser may shake the container for mixing a hair treatment lotion.

Preferably in order to fill the at least one substance into the first container at least one second container is fastened to the first container prior to the filling and unfastened after the filling. Due to the fastening the second container may be even gas tight connected to the outlet part, so that the content of the second container may not flow outwards. Particularly when the content of the second container is an aerosol, it is prevented, that the second container slips out the one-way valve due to back pressure and/or that the aerosol leaks. Further it is possible to shake the content of the first container and the second container at the same time without risking a leakage.

In the following the invention is explained in further detail with reference to the accompanying drawings by means of preferred embodiments.

Figure 1:
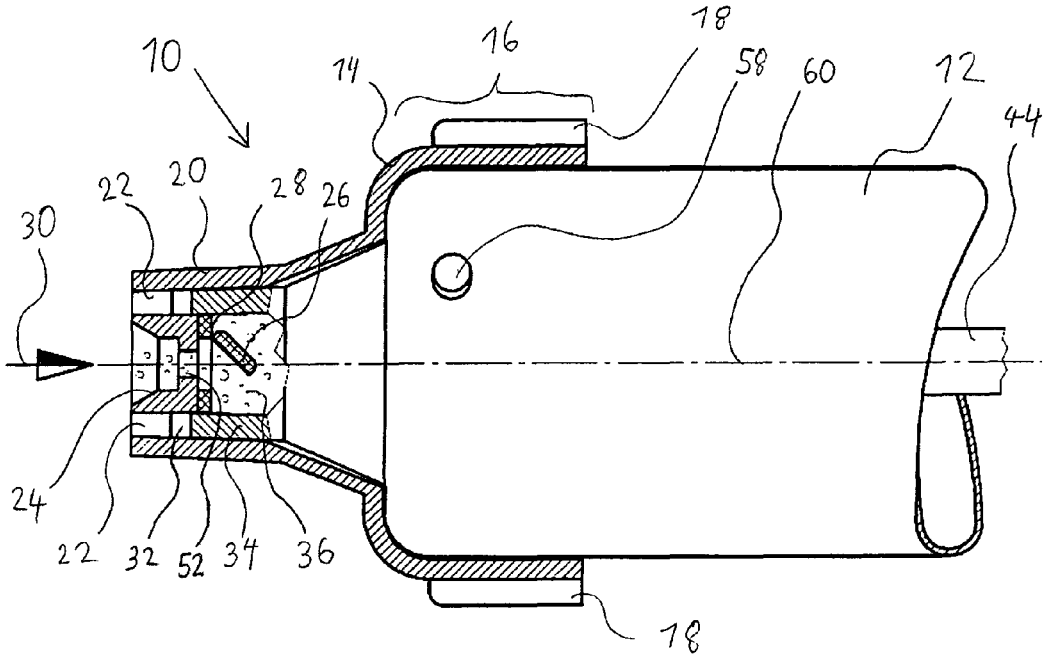
FIG. 1 shows a schematic side view of a first embodiment of a container according to the invention in closed position.

The container 10 as illustrated in FIG. 1 comprises a receiving vessel 12 and an outlet part 14, which is moveable with respect to the receiving vessel 12. The outlet part 14 encompasses the receiving vessel in a supporting area 16. The outlet part 14 comprises movement lugs 18 for facilitating the movement of the outlet part 14. The outlet part 14 comprises a mainly cylindrical outlet duct 20. From the outlet duct 20 webs 22 protrude ending at a one-way valve 24. In the illustrated embodiment the one-way valve 24 comprises a lid 26 connected the one-way valve 24 via a film hinge 28. Due to a pressure in a filling direction 30 the lid 26 opens an inlet opening 52 of the one-way valve 24, so that a fluid may be filled into the container 10. Between the outlet duct 20 and the one-way valve 24 a bypass passage 32 bypassing the one-way valve 24 is provided. In the illustrated closed position of the container 10 the bypass passage 32 is closed by a correspondingly shaped border wall 34 of an outlet opening 36 of the receiving vessel 12.

Figure 2:
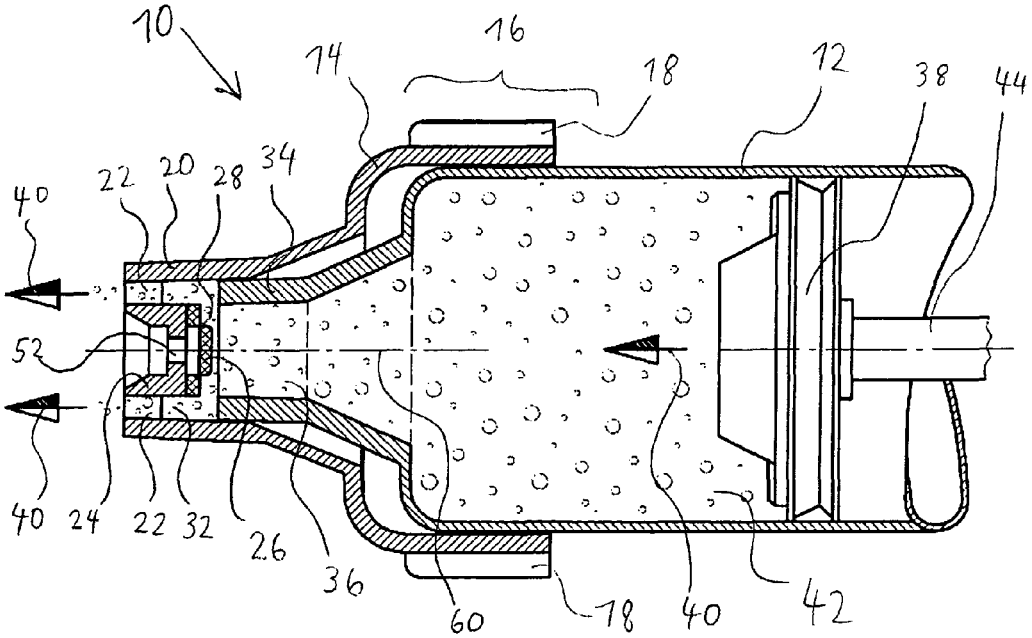
FIG. 2 shows a schematic cross sectional view of the container of FIG. 1 in closed position.

As illustrated in FIG. 2 the container 10 is in an opened position, where the outlet part 14 is moved such, that the border wall 34 opens the bypass passage 32. Due to a pressure inside the receiving vessel 12 and/or an applied pressure by means of a piston 38 moved in an emptying direction 40 a content 42 of the receiving vessel 12 is led through the bypass passage 32. At the same time the applied pressure forces the lid 26 to close the inlet opening 52 of the one-way-valve 24. For increasing the pressure inside the container 10 by hand the piston 38 is connected to a stem 44, which can be moved by hand from outside. When the piston 38 is moved against the emptying direction 40 along the filling direction 30, it is possible to reduce the pressure inside the receiving vessel 12. Particularly it is possible to apply a negative pressure inside the receiving vessel 12, by means of which the one-way valve 24 may be opened and a component 46 may be sucked in.

Figure 3:
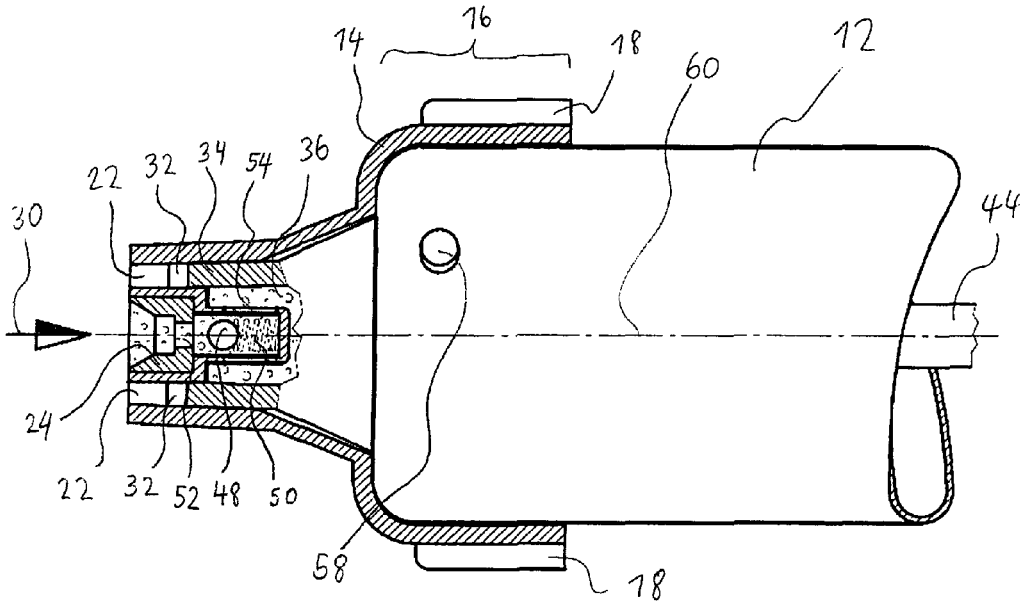
FIG. 3 shows a schematic side view of a second embodiment of a container according to the invention in closed position.
Figure 4:
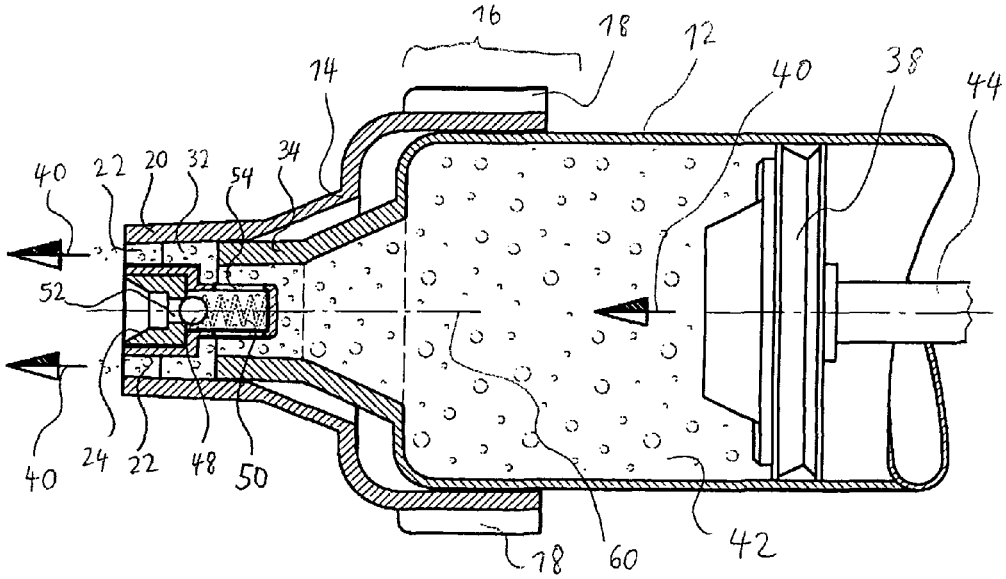
FIG. 4 shows a schematic cross sectional view of the container of FIG. 3 in closed position.

As illustrated in FIG. 3 and FIG. 4 the lid 26 of the one-way valve may be replaced by a ball 48, which is spring-loaded by means of a spring 50. The ball 48 and the spring 50 are arranged inside a cage 54. When a pressure is applied in filling direction 30, the ball 48 opens the inlet opening 52 of the one-way valve 24 against the spring force of the spring 50 and the component 46 may flow via the inlet opening 52 and the cage 54 into the receiving vessel 12 (FIG. 3). When no pressure applies (FIG. 4) the inlet opening 52 is automatically closed by the ball 48 by means of the spring force of the spring 50.

Figure 5:
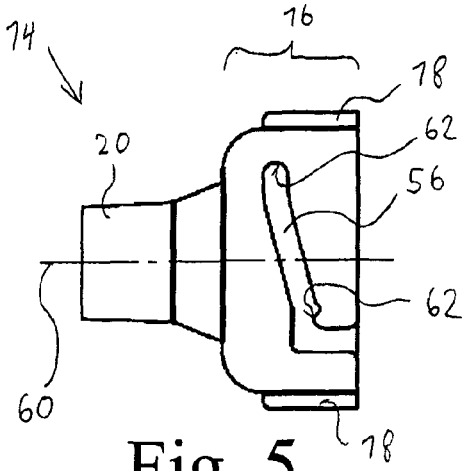
FIG. 5 shows a schematic side view of an outlet part for the containers of FIG. 1 and FIG. 3.
Figure 7:
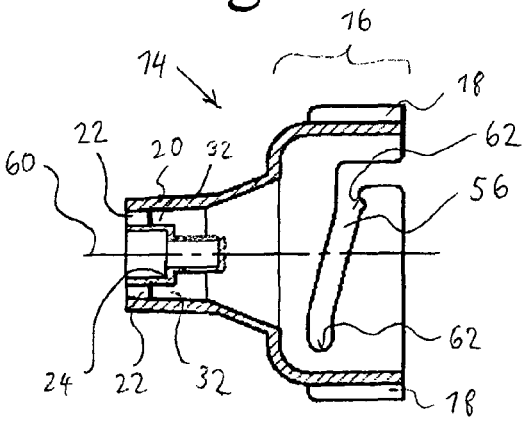
FIG. 7 shows a sectional view of the outlet part of FIG. 6 along line A-A.

As illustrated in FIG. 5 and FIG. 7 the outlet part 14 comprises two opposing guiding slots 56, into which a projection 58 of the receiving vessel 12 may be inserted. The slots 56 are inclined with respect to a middle axis 60 of the receiving vessel 12. The slots 56 each comprise two stops 62 defining the maximum movement of the projection 58 within the slots 56. Due to the stops 62 the end positions of the outlet part 14 with respect to receiving vessel 12 are defined. Due to the shape of the slots 56 the outlet part 14 may perform a displacement in axial direction and a turning around the middle axis 60 at the same time.

Figure 6:
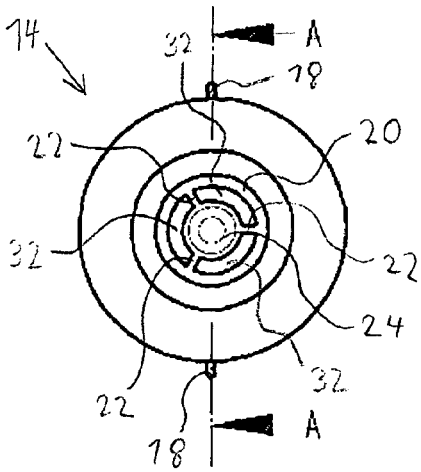
FIG. 6 shows a schematic front view of the outlet part of FIG. 5.

As illustrated in FIG. 6 the outlet part 14 may comprise three bypass passages 32 which are separated from each other in circumferential direction by three webs 22. The bypass passages 32 are bordered radially inwards by the one-way valve 24 and radially outwards by the outlet duct 20.

Figure 8:
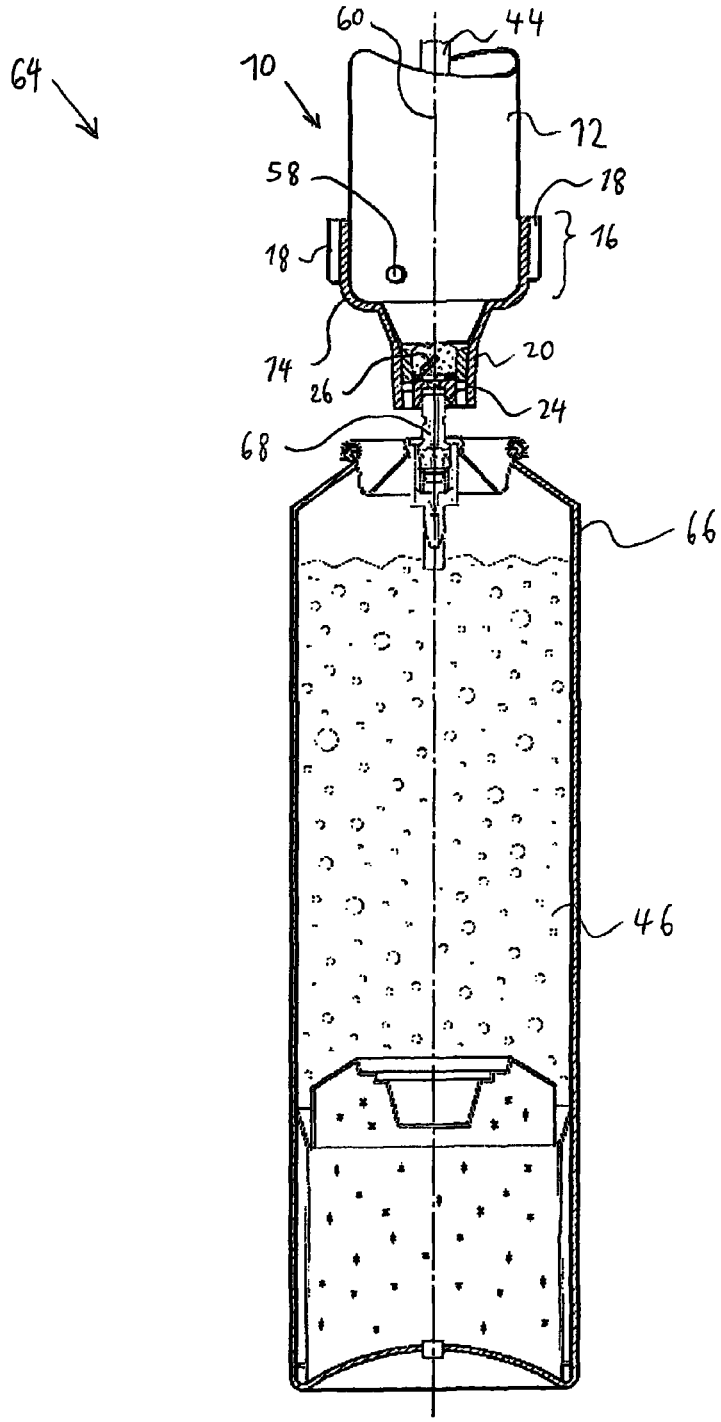
FIG. 8 shows a schematical cross sectional view of a first embodiment of a container system and FIG. 9 shows a schematical cross sectional view of a second embodiment of a container system.
Figure 9:
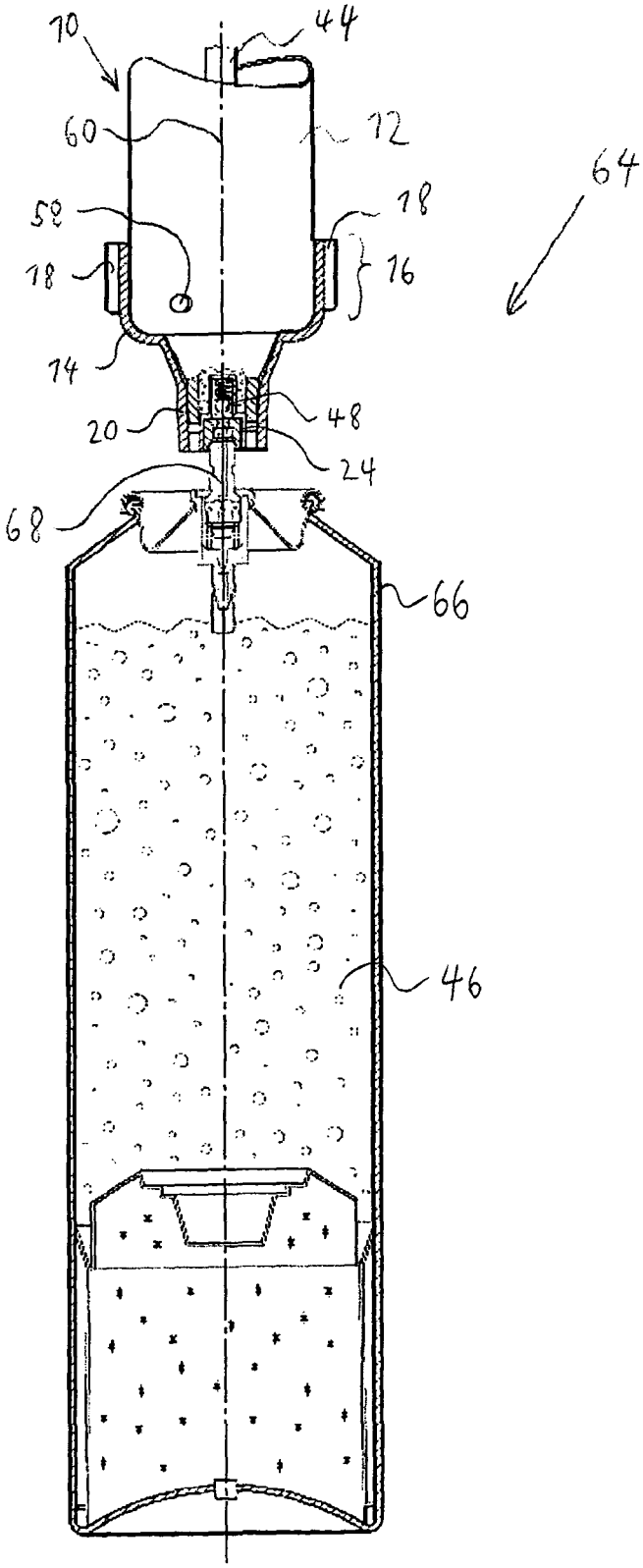

In FIG. 8 a container system 64 is illustrated, which comprises a first container 10 and a second container 66 connected to the first container via the one-way valve 24. The second container 66 comprises a component 46, which should be mixed with a content 42 of the first container 10. In the illustrated embodiment the component 46 is an aerosol, which escapes the second container 66 via a displaceable spring-loaded nozzle 68. When the nozzle 68 is pressed into the one-way valve 24 the nozzle 68 is moved inwards and provides a communication with the component 46. Due to the pressure inside the second container 66 the one-way valve 24 is automatically opened and the component 46 is filled into the first container 10. Since the pressure inside the first container 10 increases during filling, the one-way valve 24 is automatically closed, when the second container 66 is disconnected from the first container 10. As illustrated in FIG. 9 the closing of the one-way valve 24 may be further supported, when the lid 26 is replaced by a spring-loaded ball 48. Particularly when the second container 66 comprises an aerosol the pressure inside the second container 66 is sufficient to open the one-way valve 24 against the spring force of the spring-loaded ball 48.

The invention claimed is:

1. A container comprising a receiving vessel (12) and an outlet part (14), wherein the outlet part (14) comprises a one-way valve (24) and at least one bypass passage (32) bypassing the one-way valve (24), wherein the outlet part (14) is at least partly movable with respect to the receiving vessel (12) between a closed position and an opened position such that the outlet part is turnable around an axis pointing in an axial direction of the receiving vessel, wherein in the closed position the receiving vessel (12) seals the bypass passage (32) and in the opened position the receiving vessel (12) unseals the bypass passage (32), wherein due to a turning movement the bypass passages may be opened and closed.

2. A container according to claim 1 wherein the outlet-part (14) comprises an outlet duct (20) and the one-way valve (24) is connected to the outlet duct (20) via at least one web (22), wherein the bypass passage (32) is provided between the outlet duct (20), the one-way valve (24) and the web (22).

3. A container according to claim 1, wherein the receiving vessel (12) comprises an outlet opening (36) defined by a border wall (34), wherein the border wall (34) seals the bypass passage (32) in the closed position.

4. A container according to claim 1, wherein relative movement of the outlet part (14) to the receiving vessel (12) is defined by a guiding (56), wherein the guiding (56) comprises a projection (58) inserted into a slot (56), wherein the outlet part (14) is turnable around an axis (60) pointing in axial direction of the receiving vessel (12) and/or displaceable in axial direction of the receiving vessel (12).

5. A container according to claim 1, wherein the outlet part (14) comprises a thread for fastening a second container (66).

6. A container according to claim 1, wherein the one-way valve (24) is a check valve comprising a ball (48) for closing an inlet opening (52), wherein the ball (48) is loaded by a spring (50), wherein particularly the ball (48) and the spring (50) are arranged inside a cage (54).

7. A container according to claim 1, wherein the one-way valve (24) is a check valve comprising a particularly spring-loaded lid (26) for closing an inlet opening (52), wherein the lid (26) is particularly pivotable, by means of a film hinge (28).

8. A container according to claim 1, wherein the receiving vessel (12) comprises a piston (38) for changing the receiving volume of the receiving vessel (12), wherein particularly the piston (38) is connected to a stem (44) for manipulating the piston (38) from outside the receiving vessel (12) and/or wherein a mixing element is provided inside the receiving vessel (12), wherein the mixing element is actuatable from outside the receiving vessel (12) particularly via an actuating stem connected to the mixing element.

9. A container system comprising a first container (10) according to claim 1 and a second container (66) connected to the first container (10) via the one-way valve (24), wherein the second container (66) comprises a component (46) to be filled into the first container (10).

10. A container system according to claim 9 wherein the component (46) of the second container comprises a liquid and/or an aerosol and/or a substance capable of flowing, wherein particularly the viscosity of the component (46) is chosen such, that the component (46) is capable of being sucked into the first container (10) by means of an applied negative pressure inside the first container (10), wherein the negative pressure particularly counteracts a closing force of the one-way valve (24), and/or by means of a gravity force of the component (46), which at least counteracts the closing force of the one-way valve (24).

11. A container system according to claim 9 wherein the second container (66) is adapted to apply a pressure to the component (46) of the second container (66), particularly by means of a press piston and/or a pressurized gas.

12. A method for providing a composition comprising the steps of

Providing a first container (10) according to claim 1, in closed position, Filling at least one component (46) into the first container (10) via the one-way valve (24), Moving the outlet part (14) with respect to the receiving vessel (12) in opened position and—Emptying the content (42) of the first container (10) via the bypass passage (32).

13. A method according to claim 12 wherein prior to moving the outlet part (14) in opened position the first container (10) is shaken for mixing at least two components and/or wherein in order to fill the at least one component (46) into the first container (10) at least one second container (66) is fastened to the first container (10) prior to the filling and unfastened after the filling.

* * * * *